United States Patent [19]

Haverland et al.

[11] 4,347,718

[45] Sep. 7, 1982

[54] CUTTING ELEMENTS FOR KNITTING MACHINES

[75] Inventors: William H. Haverland, Conifer; Albert R. Hiler, Lakewood, both of Colo.

[73] Assignee: Hospal Medical Corporation, East Brunswick, N.J.

[21] Appl. No.: 81,576

[22] Filed: Oct. 3, 1979

[51] Int. Cl.[3] ..... D04B 23/06; D04B 23/08; D04B 23/10; D04B 23/12

[52] U.S. Cl. ..... 66/84 A; 66/145 R; 66/114

[58] Field of Search ..... 66/84 A, 84 R, 121, 66/120, 140, 145, 114

[56] References Cited

U.S. PATENT DOCUMENTS

| | | | |
|---|---|---|---|
| 263,999 | 9/1882 | Truitt | 66/121 X |
| 928,244 | 7/1909 | Burson | 66/145 B |
| 1,120,989 | 12/1914 | Williams | 66/121 |
| 2,746,275 | 5/1956 | Cobert | 66/145 B |
| 3,070,983 | 1/1963 | Hubbard et al. | 66/84 |
| 3,134,248 | 5/1964 | Kubelka et al. | 66/85 A |
| 3,188,835 | 6/1965 | Mayer et al. | 66/145 R |
| 3,364,701 | 1/1968 | Carman | 66/84 |
| 3,521,466 | 7/1970 | Tannert | 66/142 X |
| 3,552,151 | 1/1971 | Schuler | 66/84 A |
| 3,564,872 | 2/1971 | Klaeui | 66/85 A |
| 3,640,094 | 2/1972 | Piana et al. | 66/145 R |
| 3,653,105 | 4/1972 | Klaeui | 66/85 A |
| 3,699,783 | 10/1972 | Carman | 66/84 A |
| 3,911,698 | 10/1975 | Walford | 66/84 A |
| 4,220,020 | 9/1980 | Kohl | 66/84 A |

FOREIGN PATENT DOCUMENTS

| | | | |
|---|---|---|---|
| 29118 | 6/1964 | German Democratic Rep. | 66/84 |

*Primary Examiner*—Ronald Feldbaum

*Attorney, Agent, or Firm*—Gerald D. Sharkin; Robert S. Honor; Walter F. Jewell

[57] ABSTRACT

An improved cutting system for knitted fabrics, wherein a cutting element is mounted on a knitting machine for movement in unison with the needle and positioned to cut the knitted fabric to a predetermined dimension at least one cycle after the knitting cycle.

9 Claims, 6 Drawing Figures

CUTTING ELEMENTS FOR KNITTING MACHINES

BACKGROUND OF THE INVENTION

This invention relates to knitting machines. In one particular aspect, it relates to the cutting of material produced by a knitting machine to a dimension smaller than the machine normally produces.

The general elasticity of textile threads presents a problem when they are cut. In a knitted fabric, the weft threads must be cut loose from the holding devices as it passes through the machine after the warp thread has been knitted around it. When cut, the weft threads will shrink in length thereby causing the knitted material to shrink in width. This shrinkage is dependent on the elasticity of the weft material and the tension it is under at the time the warp yarn is knitted around it.

In some instances it is necessary to maintain a definite relationship of the cut material to the pattern being produced.

This invention provides a method and means for overcoming the prior art fabric cutting deficiencies and maintaining a definite relationship of the material edge to the material pattern, by cutting the weft thread one cycle after the warp yarn is knitted around it. This cutting takes place simultaneously with the moving of the knitted material from the holding devices that carry it through the machine.

SUMMARY OF THE INVENTION

Broadly, this invention provides for an improvement in the fabric cutting system of a knitting machine, having in combination at least one compound needle reciprocating between a lowest and uppermost position, means for guiding a warp thread onto and about the needle with the upward thrust of the needle, means for guiding a warp thread onto and about the needle with the upward thrust of the needle, means for urging a weft thread, e.g., hollow fiber, into position for knitting the warp thread about the hollow fiber in response to the reciprocating motion of the needle, and means for advancing the thus knitted fabric, e.g., hollow fiber mat, from the area of needle reciprocation.

The improvement comprises at least one cutting element, e.g., knife, for cutting the hollow fibers of the knitted hollow fiber mat, which knife is mounted on the knitting machine for movement in unison with the needle and positioned to cut the hollow fibers to a predetermined dimension at least one cycle after the knitting cycle.

The knife may take the place of one or more needles on the knitting machine. The knife may also be used in addition to the desired number of needles when the full compliment of needles are not being used. The knife may be mounted on the knitting machine in a conventional manner similar to that of the knitting needle.

If a plurality of knives are used they may be positioned to all cut the weft thread (hollow fiber) simultaneously to insure that each string of fabric or mat of hollow fibers is cut to the same dimension.

The cutting system of this invention is most suited for the processing of elastic-type materials.

The cutting system of this invention is especially suited for cutting hollow fiber knitted mats, wherein the hollow fiber is a polymeric water permeable, e.g., cellulusic material, useful in hemodialysis.

DESCRIPTION OF A PREFERRED EMBODIMENT

Figure 1:
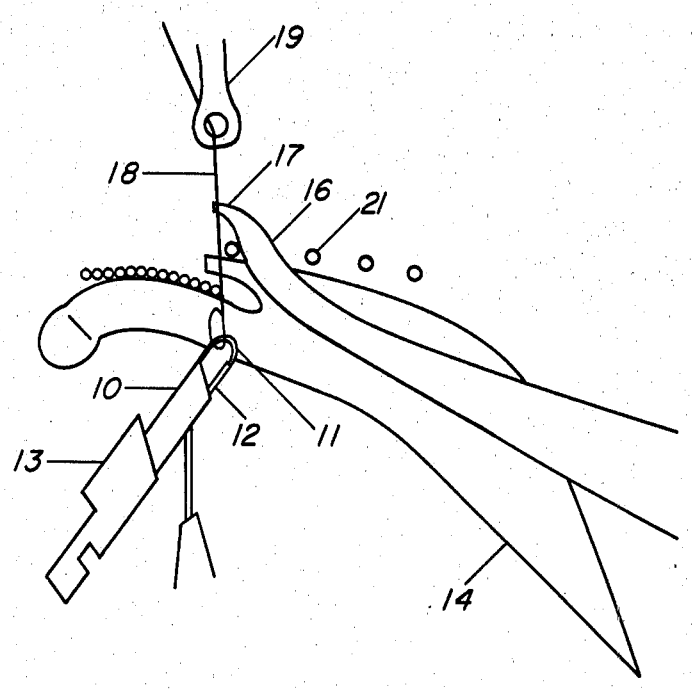
FIG. 1 to FIG. 5 depicts various stages in a conventional knitting cycle, showing a cutting element, e.g., knife, of this invention operating simultaneously with the compound knitting needle. With the exception of the novel cutting element of this invention and its placement on the knitting machine, the other elements illustrated and described herein are conventional.
Figure 2:
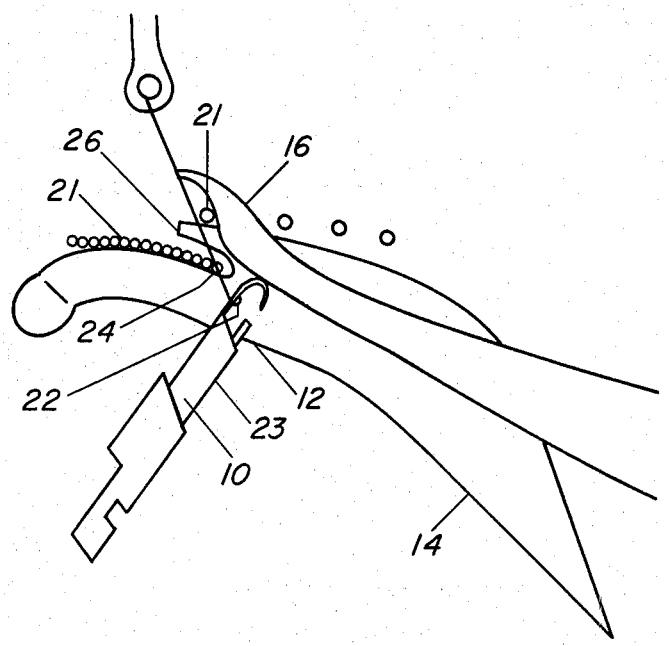
Figure 3:
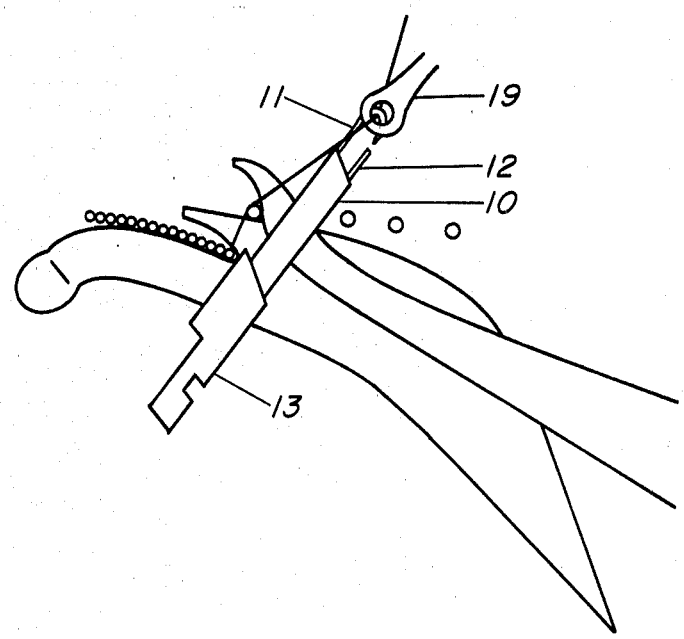
Figure 4:
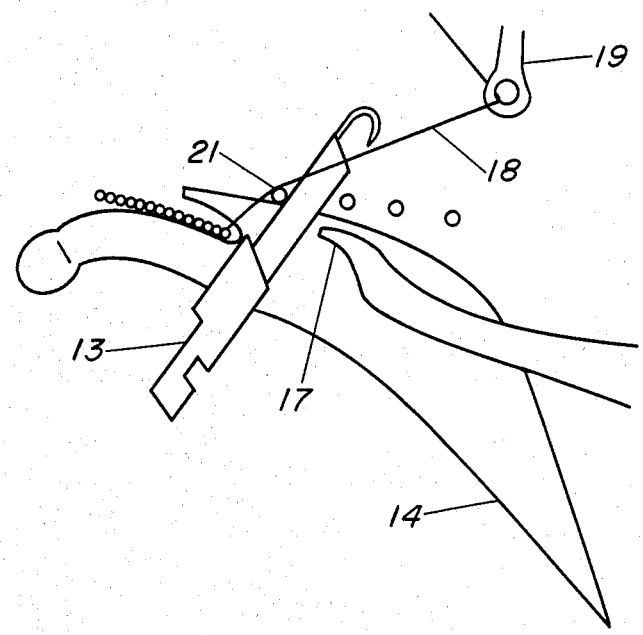
Figure 5:
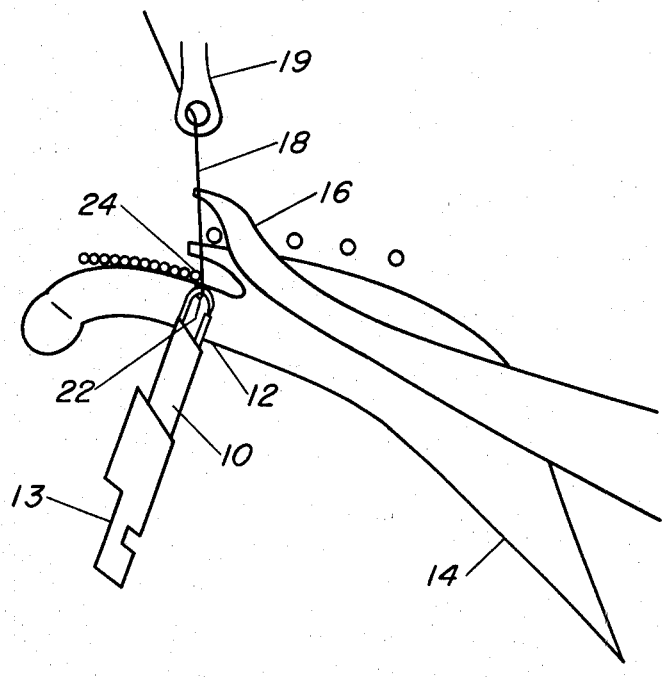
Figure 6:
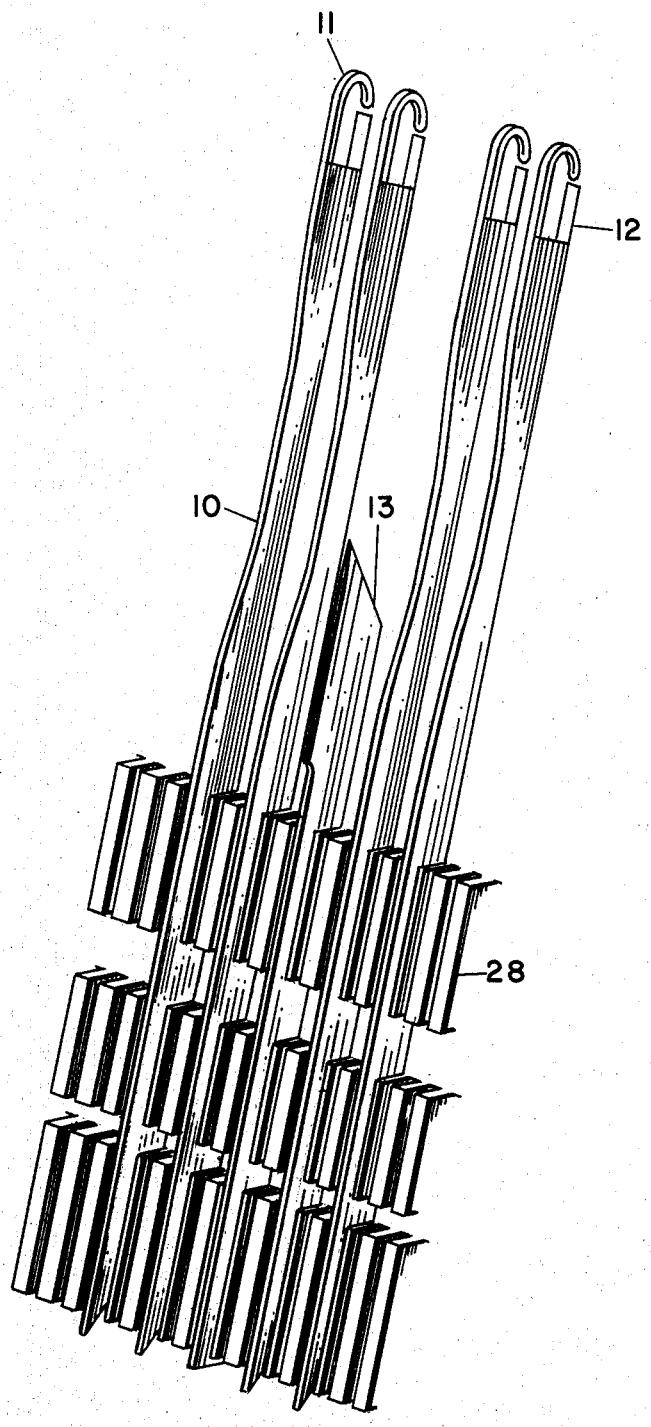
FIG. 6 is a prospective view of a single cutting means, e.g. knife, and compound knitting needles, mounted on a warp knitting machine 28.

The following discussion describes the operation of the novel cutting system of this invention on a knitting machine, e.g., Liba Copcentra HS, with respect to the knitting and cutting of a fabric, e.g., hollow fiber mat for an artificial kidney. The hollow fibers are cut one cycle after the knitting cycle. Thus maintaining an absolute relationship of the cut fabric to the pattern being produced.

The knitting and cutting are described with respect to a single unit for descriptive purposes. It is understood that in conventional operation, a multiplicity of units are in fact used and contemplated by this invention.

FIG. 1

Starting Point (Knitted Hollow Fiber in the Knock-Over Position)

The compound needle 10 has its head 11 covered by the tongue 12 and is in its lowest knock-over position. The cutting element 13 (e.g., knife) is also in its lowest position. The sinker bar 14 begins to swing forward with the insertion sinker 16 at its highest and foremost position. The tip 17 of the insertion sinker 16 reaches the warp thread 18 of the guide bar 19, insuring that the weft thread 21 (e.g., hollow fiber) is enclosed.

FIG. 2

Holding Down the Previously Knitted Hollow Fiber

The needle 10 and the knife 13 begin to rise. A previously formed loop 22 of warp thread begins to slide over the needle breast onto the needle shaft 23. The previously knocked-over stitches 24 are stretched to their definite size. The sinker bar 14 is now in its forward holding down (enclosing) position, and the knitted hollow fiber 21 is held down by the nose 26 of the sinker 14. The guide bar 19 completes the underlapping. The tongue 12 remains in the interior position and passes back in a groove (not shown) in the needle 10. The insertion sinker 16 remains in the foremost position until the hollow fibers 21 are enclosed.

FIG. 3

Cutting of the Knitted Hollow Fiber

The needle 10 and the knife 13 are nearly in their uppermost position and the knife begins to cut the previously knit hollow fiber. The needle tongue 12 begins to rise in the needle groove. The guide bar 19 has completed its underlapping and has begun to swing toward the rear. The insertion sinker remains in its foremost position until the guide of the guide bar has reached the center of the needle head 11 and the knife and needle have reached their uppermost position, with the knife cutting through the hollow fiber.

FIG. 4

Overlapping of the Knitted Hollow Fiber

The guide bar 19 swings to its rear reverse position and the warp thread 18 overlaps the needle 10. The guide bar then begins to swing forward. The insertion sinker tip 17 immerses into the holding down sinker 14 as soon as the warp thread 18 of the guide bar 19 secures the hollow fiber 21 on the needle back. The needle 10 and the knife 13 remain in their uppermost position during this overlapping operation.

FIG. 5

Knock-Over of Knitted Hollow Fiber

The guide bar 19 has swung into its forward position and inserted the warp thread 18 into the neck of the needle 10. The needle and the knife 13 are in a downward motion with the tongue 12 of the needle beginning to close. The previously formed loop 22 of the warp thread slides from the needle shaft as the needle moves downward. The sinker bar 14 has moved to its most backward reversing position and begins moving forward.

The insertion sinker 16 emerges from its hindmost position. The knife 13, needle 10 with the tongue 12 covering the needle head immerse into the knock-over sinker bar 14. At this time, the formed stitch 24 slides from the head of the needle. The warp thread 18 around the neck of the needle 15 is pulled by the hook of the needle through the knocked-over stitch 24 to form a new stitch. The sinker bar 14 begins moving forward with the insertion sinker 16 arriving at its foremost position. The cycle is repeated beginning again with FIG. 1.

What is claimed is:

1. In a fabric knitting machine having in combination at least one needle reciprocating between a lowest and uppermost position defining a knitting cycle, means for guiding warp thread onto and about the needle with the upward thrust of the needle, means for urging a weft thread into position for knitting the warp thread about the weft thread in response to the reciprocating motion of the needle, and means for advancing the thus knitted fabric from the area of needle reciprocation at the completion of the knitting cycle, the improvement which comprises at least one cutting element for cutting the weft thread of the knitted fabric to a predetermined dimension, the element mounted on the knitting machine in a needle position for movement in unison with, but in spaced relationship to the needle, to cut the weft thread of the previous knitting cycle.

2. The fabric knitting machine according to claim 1 wherein the cutting element is a knife.

3. The fabric knitting machine according to claim 1 wherein there are a plurality of cutting elements.

4. A fabric cutting system for textile machinery comprising a fabric knitting machine having in combination at least one reciprocating needle for knitting the fabric, the reciprocation between a lowest and uppermost position defining a knitting cycle, and at least one cutting element for cutting the weft thread of the knitted fabric to a predetermined dimension, the cutting element mounted on the knitting machine in a needle position for movement in unison with but in spaced relationship to the needle, whereby the weft thread of the previous knitting cycle is cut by the cutter element.

5. A process for knitting fabric on a knitting machine which comprises reciprocating a needle between a lowest and uppermost position of a knitting cycle, guiding a warp thread onto and about the needle with the upward thrust of the needle, urging a weft thread into position for knitting the warp thread about the weft thread in response to the reciprocating motion of the needle to form a knitted fabric, advancing the thus knitted fabric from the area of needle reciprocation, and moving a cutting element in unison with the needle to cut the weft thread of the previous knitting cycle to a predetermined dimension.

6. A hollow fiber knitted mat cutting system for textile machinery, comprising a hollow fiber mat knitting machine having in combination at least one needle reciprocating between a lowest and uppermost position defining a knitting cycle, means for guiding warp thread onto and about the needle with the upward thrust of the needle, means for urging a hollow fiber into position for knitting the warp thread about the hollow fiber in response to the reciprocating motion of the needle, and means for advancing the thus knitted hollow fiber mat from the area of needle reciprocation at the completion of the knitting cycle, and at least one cutting element for cutting the hollow fiber of the knitted hollow fiber mat to a predetermined dimension, the element mounted on the knitting machine in a needle position for movement in unison with, but in spaced relationship to the needle, to cut the hollow fiber of the previous knitting cycle.

7. The hollow fiber knotted mat cutting system of claim 6 wherein the cutting element is a knife.

8. The hollow fiber knitted mat cutting system of claim 6 wherein there are a plurality of cutting elements.

9. A process for knitting a hollow fiber mat on a knitting machine which comprises reciprocating a needle between a lowest and uppermost position of a knitting cycle, guiding a warp thread onto and about the needle with the upward thrust of the needle, urging a hollow fiber into position for knitting the warp thread about the hollow fiber in response to the reciprocating motion of the needle to form a hollow fiber mat, advancing the thus knitted hollow fiber mat from the area of needle reciprocation, and moving a cutting element in unison with the needle to cut the hollow fiber of the previous knitting cycle to a predetermined dimension.

* * * * *